US005654745A

United States Patent [19]

Luque

[11] Patent Number: 5,654,745

[45] Date of Patent: Aug. 5, 1997

[54] TONER PROJECTION PRINTER WITH CAPACITANCE-COUPLED ADDRESS ELECTRODE STRUCTURE

[75] Inventor: Phillip R. Luque, Boise, Id.

[73] Assignee: Hewlett-Packard Company, Palo Alto, Calif.

[21] Appl. No.: 498,934

[22] Filed: Jul. 6, 1995

[51] Int. Cl.[6] ..... B41J 2/06

[52] U.S. Cl. ..... 347/55; 347/12; 347/142; 347/145

[58] Field of Search ..... 347/12, 55, 142, 347/145

[56] References Cited

U.S. PATENT DOCUMENTS

| | | | |
|---|---|---|---|
| 4,823,284 | 4/1989 | Ward | 364/519 |
| 5,036,341 | 7/1991 | Larson | 346/154 |
| 5,121,144 | 6/1992 | Larson et al. | 346/154 |
| 5,400,062 | 3/1995 | Salmon | 347/55 |
| 5,444,470 | 8/1995 | Muto et al. | 347/15 |
| 5,515,084 | 5/1996 | Larson | 347/55 |

FOREIGN PATENT DOCUMENTS

| | | |
|---|---|---|
| WO90/14959 | 12/1990 | WIPO . |
| WO90/14960 | 12/1990 | WIPO . |

*Primary Examiner*—Daniel P. Malley

[57] ABSTRACT

A toner projection printer is provided with a developer surface which manifests a developer bias, and includes a cloud of entrained toner particles. A platen is positioned opposed to the developer surface and manifests a platen voltage that is attractive to the toner particles. An address plate is positioned between the developer surface and the conductive platen. The address plate includes a determined thickness insulator with through pixel apertures. Each pixel aperture has at least a first conductive electrode ring positioned within the insulator and connected to a drive plate that is also positioned within the insulator. A first drive circuit positioned on one side of the insulator and is capacitively coupled to the drive plate for controllably applying a row drive voltage thereto. A second drive circuit is positioned on a second side of the insulator and is capacitively coupled to the drive plate for controllably applying a column voltage drive thereto). Both the column and row drive voltages are set at levels so that only when both are high can toner particles pass through the pixel aperture and be drawn towards the platen and come under the influence of the platen voltage. Control circuitry operates to enable deposition of row and column dots of toner on a media sheet positioned on the platen.

8 Claims, 4 Drawing Sheets

$v1 = Vc \times Cc/(Cc + Cr + Ce)$ $v2 = Vr \times Cr/(Cc + Cr + Ce)$ $v3 = (Vc \times Cc + Vr \times Cr)/(Cc + Cr + Ce)$ $v3 - v4 = Qt/(Cc + Cr + Ce)$

TONER PROJECTION PRINTER WITH CAPACITANCE-COUPLED ADDRESS ELECTRODE STRUCTURE

FIELD OF THE INVENTION

This invention relates to electrostatic printing devices and, more particularly, to a toner projection printer employing an electrostatic toner deposition control and an improved pixel address mechanism.

BACKGROUND OF THE INVENTION

The most widely used electrophotographic print apparatus employs a movable photoconductor which is selectively exposed by a source of optical energy. While such electrophotographic printers have been widely accepted and produce excellent print quality at reasonable cost, continued efforts are being directed to increase their performance and further reduce their cost. However, photoconductor-based printers will continue to exhibit certain problems which inherently arise from the use of a photoconductor. Among those are the cost of the photoconductor, photoconductor wear; and photoconductor sensitivity to light requiring continual shielding. Further, when an image is fully developed on the photoconductor, a transfer action must occur to enable removal of the toner to a media sheet.

Recently, a new class of electrostatic printers has been developed which requires no photoconductor and avoids many problems inherent with the use of the photoconductor. That class of printers comprise "toner projection printers" which include a system of electrodes for controlling direct deposition of charged toner particles on a media sheet without an intervening photoreceptor or photoconductive device. Typically each electrode includes a conductive electrode ring surrounding a hole in an insulating substrate. On one side of the substrate is a developer module which includes a developer roll and a supply of charged dry toner particles.

For a system employing negatively charged toner particles, when an electrode ring is driven positive with respect to the developer roll, the toner particles are attracted to the electrode ring and some pass through the hole. On the opposite side of the insulating substrate is a media sheet which rests on a conductive platen. The platen is biased to a voltage that is more positive than the electrode ring so that toner particles are attracted to the paper/platen combination.

Toner that is attracted to the electrode ring but does not path through the aperture, collects around the aperture and must be removed periodically. This is accomplished by reversing the potential between the electrode ring and the developer roll to pull such toner deposits away from the insulating substrate and electrode ring and back to the developer roll. Due to the fact that each electrode ring requires an independently controllable driver circuit, a large number of driver circuits are required, with attendant complex wiring and control circuitry.

U.S. Pat. No. 5,036,341 to Larson et al. describes a toner projection printer wherein the print control matrix comprises two layers of parallel wires in each of two layers. The two layers are orthogonal and are disposed parallel to the plane of a media sheet upon which the toner is to be developed. The wires in each layer are arranged in the form of a bar pattern and each separate wire is connected to a drive circuit. A toner dot is printed when two adjacent wires in each layer are driven positively (assuming a negatively charged toner). Toner is then drawn to a hole at the intersection of the two pairs of positively driven wires, passes therebetween and is deposited upon a media sheet.

The Larson system exhibits a number of disadvantages. The array of wires can only be supported by a frame structure around the edge of the print array. Very little sag in the wires can be tolerated due to the tight spacing control which must be maintained between the print wire array and the paper. The array of wires is fragile and each layer must be perfectly insulated from the other, which is difficult considering the number of cross-over points. There also may be some leakage of toner through adjacent holes between wire pairs. Lastly, the holes formed by the intersecting wires are square and may not provide optimum shaped dots for best print resolution.

U.S. Pat. No. 5,121,144 to Larson describes a multiplexing system for a toner projection printer. In lieu of employing a continuous conductive platen behind the media sheet upon which toner is to be deposited, the Larson '144 patent utilizes an insulating platen which includes many conducting wires that are inlaid across the direction of movement of the media sheet. Electrodes which control toner deposition are positioned on an insulating substrate above the media sheet and are connected together in a number of sets, so that only one electrode in each set is directly over a given wire in the conductive platen. Only one platen wire at a time is driven to a high positive voltage (for a negatively charged toner). When an electrode set is also driven positive, the single electrode which resides over the active wire in the platen causes a deposition of toner on the media sheet.

The structure shown in the '144 Larson patent also exhibits a number of disadvantages. The platen structure is complex and includes many precision-inlaid conductors. The insulation between these conductors must withstand a high voltage (e.g., approximately 1000 volts) and must maintain insulating properties, even though it is subject to wear as media sheets pass over it. The drive circuits for the platen wires must also be capable of driving a high voltage—which is a much higher voltage than that required to drive the print electrodes directly (approximately 100 volts). The higher voltage drive circuits are correspondingly more expensive. Finally, the platen with its inlaid wires must be precisely aligned with the printing electrode array to achieve acceptable print quality.

PCT published Application WO 90/14960 to Larson describes an improvement to the electrode structure shown in the Larson '341 patent referred to above. In the PCT published Application, Larson employs isolation electrodes to reduce cross coupling or cross talk between adjacent mesh electrodes. In PCT published Application WO 90/14959 to Larson, a procedure is described for removing deposited toner from an electrode matrix which employs a reverse voltage application during periods between address times. However, when toner particles adhere to the electrode rings, they tend to lose their charge by conduction through the electrode rings. Thus, application of a reverse voltage to remove such particles is ineffective due to their loss of charge.

As can be seen from the above, while toner projection printers eliminate the need for a photoconductor belt or surface, cost and performance improvements are required before the benefits to be obtained by the elimination of the photoconductor component will be realized.

Accordingly, it is an object of this invention to provide an improved toner projection printer which employs a reduced number of print electrode drivers.

It is another object of this invention to provide a toner projection printer which exhibits improved toner removal from print control electrodes.

SUMMARY OF THE INVENTION

A toner projection printer is provided with a developer surface which manifests a developer bias, and includes a cloud of entrained toner particles. A platen is positioned opposed to the developer surface and manifests a platen voltage that is attractive to the toner particles. An address plate is positioned between the developer surface and the platen. The address plate includes a determined thickness insulator with through pixel apertures. Each pixel aperture has at least a first conductive electrode ring positioned within the insulator and connected to a drive plate that is also positioned within the insulator. A first drive circuit positioned on one side of the insulator and is capacitively coupled to the drive plate for controllably applying a row drive voltage thereto. A second drive circuit is positioned on a second side of the insulator and is capacitively coupled to the drive plate for controllably applying a column voltage drive thereto). Both the column and row drive voltages are set at levels so that only when both are high can toner particles pass through the pixel aperture and be drawn towards the platen and come under the influence of the platen voltage. Control circuitry operates to enable deposition of row and column dots of toner on a media sheet positioned on the platen.

DETAILED DESCRIPTION OF THE INVENTION

Figure 1:
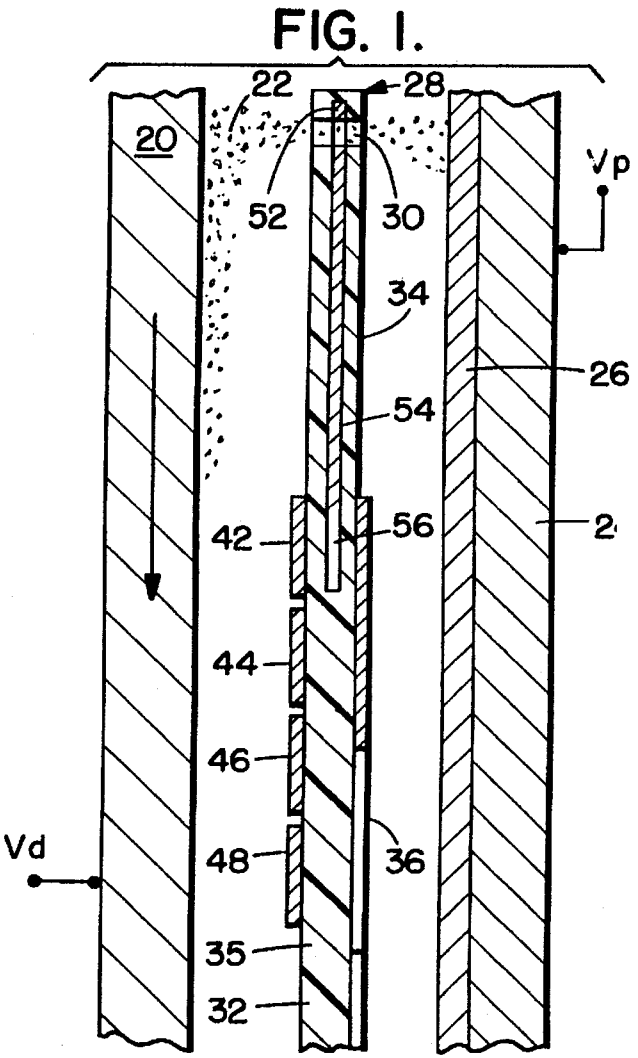
FIG. 1 is a schematic sectional view of a portion of the toner projection printer including the developer surface with entrained toner, an address plate and a conductive platen with a media sheet positioned thereon.

Referring to FIG. 1, the print portion of the toner projection printer is shown in section. A developer roll surface 20 is preferably comprised of a conductive elastomer and has applied thereto a developer bias Vd. Toner 22 is adherent to developer roll surface 20 by virtue of charge attraction between the toner particles and developer bias Vd. In a preferred embodiment, toner particles 22 are single component dielectric particles that are negatively charged.

In opposition to developer roll surface 20 is a conductive platen 24 which has applied thereto a bias voltage Vp. Voltage Vp is highly positive (e.g., 1000 volts) and creates a high electrostatic field that is attractive to toner particles 22. A media sheet 26 is positioned on conductive platen 24 and is positioned to receive toner dots configured in an image format.

Positioned between developer roll surface 20 and conductive platen 24 is an address plate 28 which, in accordance with appropriate row and column drive potentials, enables toner particles 22 to selectively pass through apertures 30 to come under the influence of the electric field created by voltage Vp applied to conductive platen 24.

Figure 2:
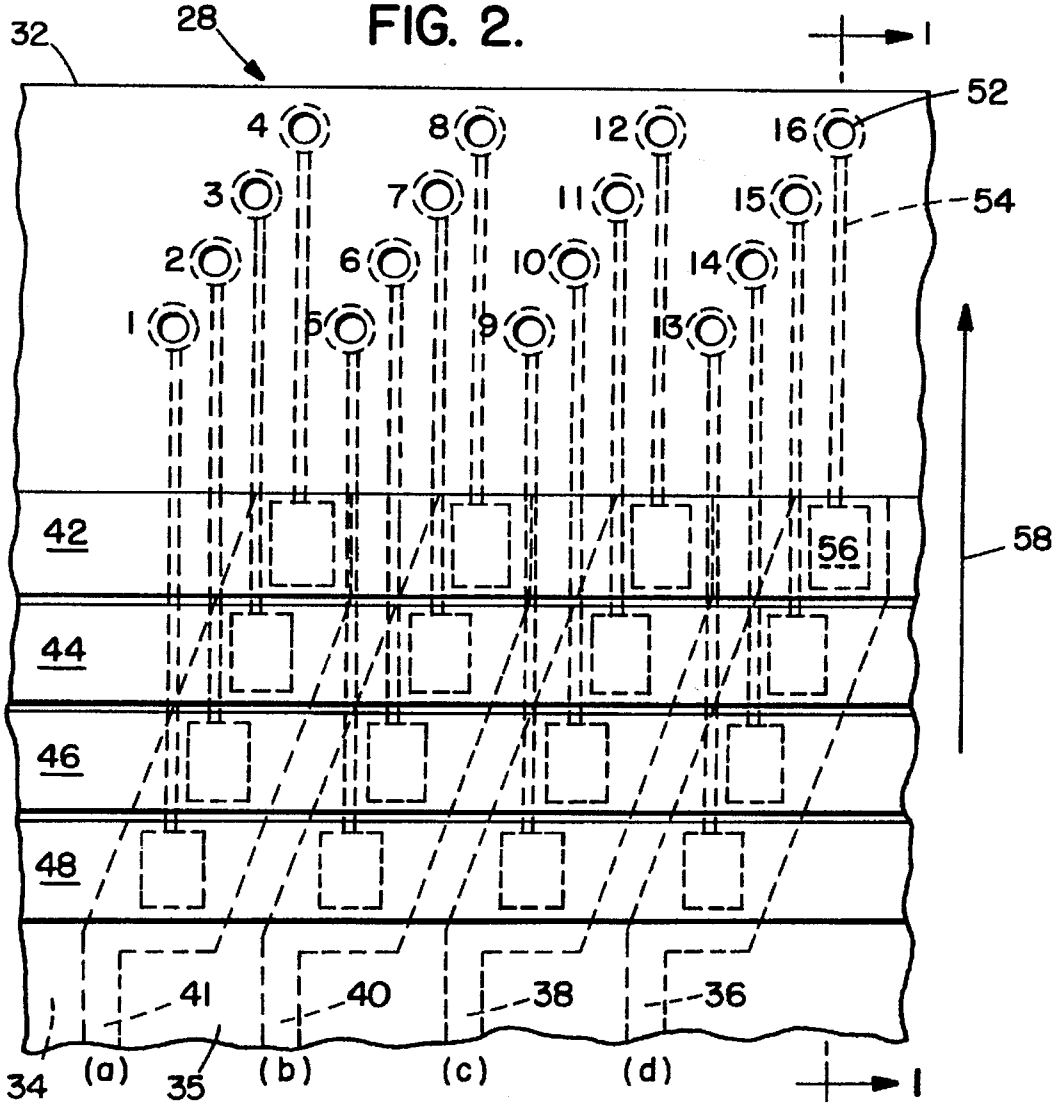
FIG. 2 is a plan view of the address plate.

A partial plan view of address plate 28 is shown in FIG. 2, and only a single aperture and associated electrodes are shown in FIG. 1. Aperture plate 28 comprises an insulating sheet 32 having a first surface 34 on which a plurality of column traces 36, 38, 40, etc. are positioned. On opposing surface 35, a plurality of row traces 42, 44, 46 and 48 are positioned so as to intersect the respective column traces. A conductive electrode ring 52 is embedded within insulating sheet 32 and is positioned about each aperture 30. Each conductive electrode ring 52 is connected by a conductive line 54 to a coupling plate 56. Each coupling plate 56 is positioned between a respective row trace and a column trace to enable drive voltages to be coupled therefrom.

As will become apparent from the description below, the positioning of electrode rings 52, conductive lines 54 and coupling plates 56 within insulating sheet 32 prevents toner particles from coming into contact with the conductive surfaces of the electrode rings and drive circuitry. As a result, conductive discharge of toner particle charges is largely avoided.

Each column trace 36, 38, 40, etc. is connected to a column driver circuit (to be described below) which applies a column drive voltage Vc(t) to each of the connected column traces, In a similar manner, each of row traces 42, 44, 46, 48, etc. is connected to a row driver (to be described below) which selectively applies a row drive voltage Vr(t) thereto. Arrow 58 illustrates the direction of movement of a media sheet beneath address plate 28.

Figure 3:
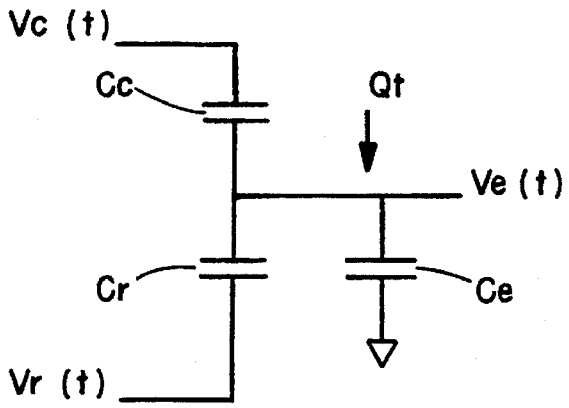
FIG. 3 shows an equivalent circuit of a ring electrode and its associated coupling capacitances.

FIG. 3 shows the equivalent circuit of an electrode and its associated coupling capacitances where:

Vc(t)=voltage on a column trace

Vr(t)=voltage on a row trace

Ve(t)=voltage on ring electrode

Vd=developer bias voltage

Cr=capacitance between row trace and coupling plate

Cc=capacitance between column trace and coupling plate

Ce=parasitic capacitance of ring electrode to ground

Qt=charge of toner that collects about the ring electrode

Vc=peak voltage of pulse on column trace

Vr=peak voltage of pulse on row trace

Figure 4:
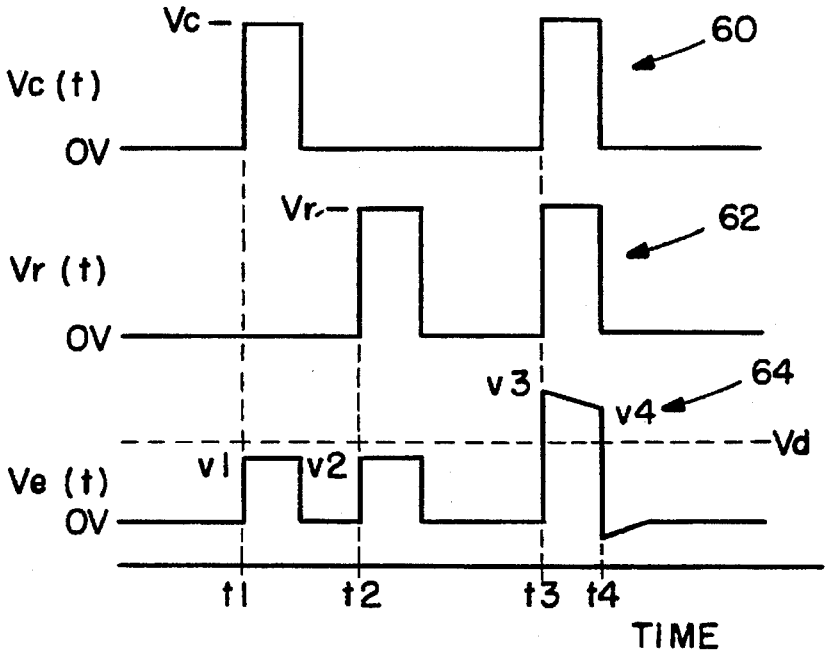
FIG. 4 illustrates waveforms helpful in understanding the equivalent circuit of FIG. 3.

FIG. 4 illustrates voltage waveforms that occur in the equivalent circuit of FIG. 3. Voltage waveform 60 illustrates the column drive, voltage waveform 62 the row drive and waveform 64 the voltage induced on coupling plate 56 (and electrode ring 52). Voltages v1, v2, v3 and v4, which occur at times t1, t2, t3 and t4, respectively, are derived as follows:

$$v1=Vc\times Cc/(Cc+Cr+Ce)$$

$$v1=Vr\times Cr/(Cc+Cr+Ce)$$

$$v3=(Vc\times Cc+Vr\times Cr)/(Cc+Cr+Ce)$$

$$v3-v4=Qt/(Cc+Cr+Ce).$$

Those skilled in the art will understand that negatively charged toner particles will only move towards platen potential Vp if the intervening potential on a ring electrode is at least as high as Vd and, preferably, is more positive in potential. Thus, if v1<Vd and v2<Vd and v3>Vd, then toner will be attracted to the ring electrode when Vr(t) and Vc(t) are at Vr and Vc, respectively. Some of the toner will pass through the aperture 30 and be attracted to the media sheet 26 by the bias voltage Vp on the conductive platen 24. When Vr(t) and/or Vc(t) are at their low levels (e.g. at times t1 and t2), the induced ring electrode voltage Ve(t) will be below the developer bias voltage Vd. The reverse field tends to pull excess toner off of address plate 28 and back onto developer surface 20. The reduction in voltage at t4 is the result of toner accumulation about aperture 30. As thus can be seen, proper adjustment of the row and column drive potentials achieves a half-select capability for address plate 28. Instead of therefore requiring a driver circuit for each of M×N pixel apertures 30, only M+N driver circuits are required.

Figure 5:
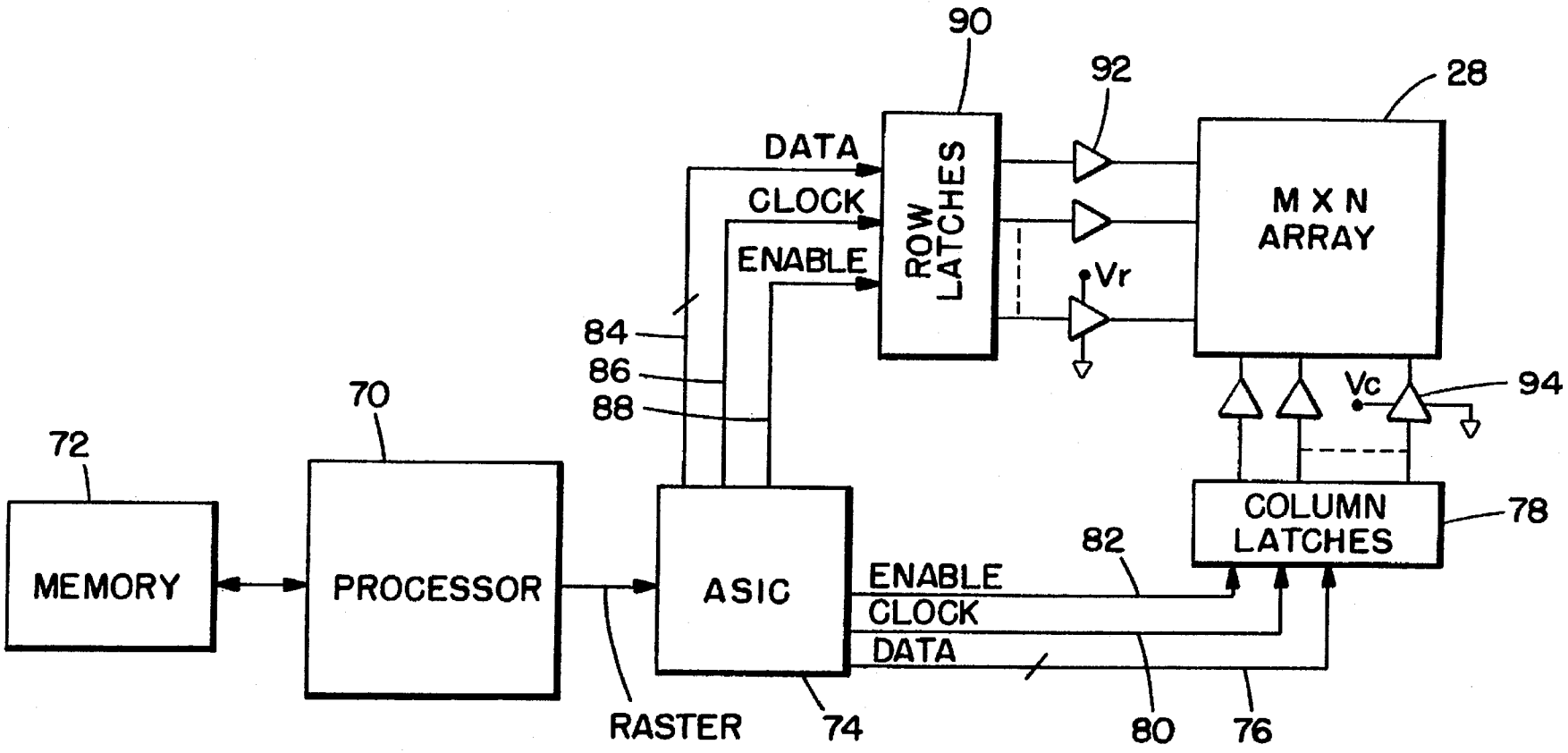
FIG. 5 is a circuit diagram illustrating circuitry for applying row and column drive potentials to the row and column traces on the address plate of FIG. 2.

In FIG. 5, circuitry is shown for addressing the array of pixel apertures 30 in address plate 28. A processor 70 and connected memory 72 combine to provide raster-oriented binary pixel data to an application specific integrated circuit (ASIC) 74. Within ASIC 74, the raster data is organized so that half select signals for the column traces are output on data lines 76 to a plurality of column latches 78. A clock line 80 enables operation of latches 78 in accordance with an enable signal that is impressed by ASIC 64 onto line 82. In similar fashion, ASIC 74 applies data, clock and enable signals via lines 84, 86, 88, respectively to row latches 90 which enable column drive signals to be applied to sequential column traces. The outputs from row latches 90 and column latches 78 are applied to row and column drivers 92, 94, respectively. Each row driver 92 and column driver 94 applies a drive voltage Vr(t), Vc(t) to a connected row or column trace. The drive voltage varies between a high level and a low or reference potential level.

In operation, ASIC 74 first loads column latches 78 with appropriate data signals and then provides enable signals to both a selected row latch in row latches 90 and to column latches 78 to cause a simultaneous readout of drive voltages on respectively connected row and column traces. These actions enable appropriate voltages to be capacitively coupled to electrode rings 52 where pixels are to be printed—thereby enabling passage of toner particles through apertures 30 located thereat. Such toner particles then come under the influence of the platen bias, are attracted to and deposited on media sheet 26.

As shown in FIG. 2, column traces 36, 38, 40, etc. are positioned on a slant so as to enable improved resolution to be obtained by closer packing of pixel apertures 30. To print a complete line, a plurality of rows of data must be printed in order to obtain the complete pixel row. ASIC 74 synchronizes the print action with the movement of media sheet 26 over platen 24. The means for moving media sheet 26 are not shown, but are well known to those skilled in the art.

Figure 6:
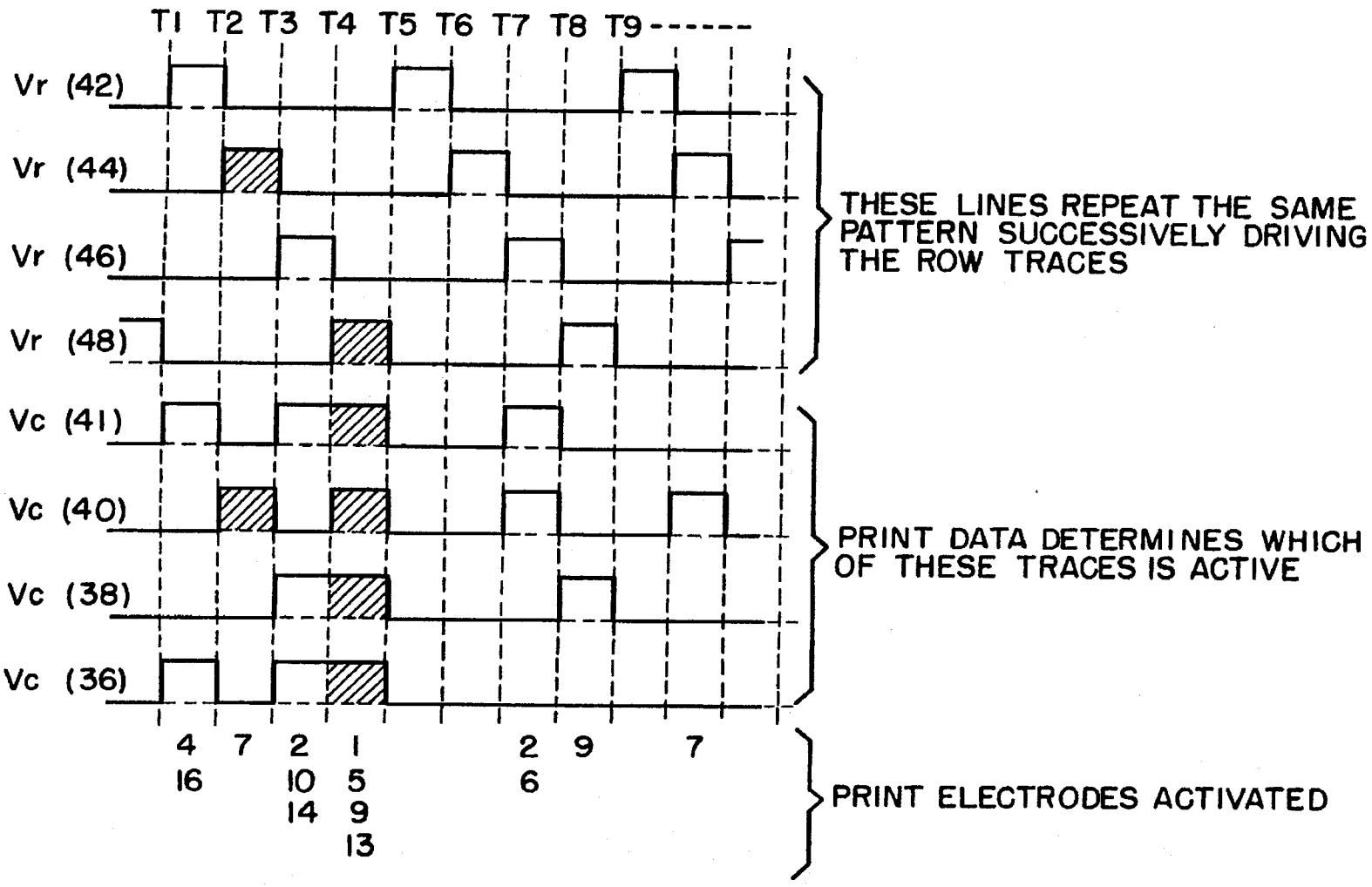
FIG. 6 shows plots of drive voltage versus time helpful in understanding the operation of the circuit of FIG. 5.

In FIG. 6, waveforms are plotted which are employed during operation of the invention. Row drive voltages are applied to sequential row traces (e.g. 42, 44, 46, 48, etc.) during succeeding clock periods. Simultaneously with application of a row drive voltage to a row trace, data signals for the particular row are applied on column traces (e.g. 36, 38, 40, etc.). When both the data and column trace drive voltage are at the high level, the printing of a dot occurs at an aperture 30 that is connected to a coupling plate 56 positioned at the intersection between the row and column traces.

As shown in FIG. 6, the coincident drive voltages applied at time T2 to row trace 44 and column trace 40 cause a dot to be printed at pixel aperture 7. Similarly, dots are printed at time T4 at pixel apertures 1,5,9 and 13. Assuming only four row traces are present on address plate 28, the sequencing of row voltages to the row traces repeats at time T6.

It should be understood that the foregoing description is only illustrative of the invention. Various alternatives and modifications can be devised by those skilled in the art without departing from the invention. For instance, the above description has assumed the presence of a media sheet passing beneath address plate 28. By contrast, conductive platen 24 can be made movable so as to directly receive the toner deposits and then to move them to a transfer point where they are removed to a media sheet. Accordingly, the present invention is intended to embrace all such alternatives, modifications and variances which fall within the scope of the appended claims.

What is claimed is:

1. An electrostatic apparatus for applying toner to a sheet, said apparatus comprising:

a developer surface manifesting a voltage bias Vd;

toner particles entrained about said developer surface by charge attraction;

platen means in opposed position to said developer surface and manifesting a voltage bias Vp that exerts an attractive force on said toner particles;

address plate means disposed between said developer surface and said platen means and comprising an insulator of determined thickness having plural apertures therethrough, each said aperture juxtaposed to at least a first electrode, said first electrode connected to a coupling plate;

row drive means capacitively coupled via said coupling plate to said first electrode for controllably applying a row drive voltage which is either at a reference level or a drive level;

column drive means capacitively coupled to said coupling plate for controllably applying thereto a column drive voltage which is either at a reference level or a drive level, said column drive voltage and row drive voltage manifesting drive levels such that only when both are at their respective drive levels is sufficient voltage induced on said coupling plate and first electrode to enable said toner particles to pass through said aperture and to be drawn towards said platen,means under influence of Vp; and control means for operating said row and column drive means to concurrently output said drive level voltages when toner particles are to pass through said aperture and to further operate at least one of said row drive means and column drive means to manifest a reference voltage if toner particles are to be inhibited from passage through said aperture.

2. The electrostatic apparatus as recited in claim 1 wherein a media sheet is positioned between said platen means and said address plate means and receives said toner particles when said toner particles pass through said aperture.

3. The electrostatic apparatus as recited in claim 1, wherein means are provided to move said platen means so as to enable toner deposited thereon to be moved to a transfer station and transferred to a media sheet.

4. The electrostatic apparatus as recited in claim 1, wherein said address plate means comprises:

M apertures arranged in N rows, each of said N rows having M/N apertures, where M and N are integer values, and a full row of toner dots on a media sheet comprises M×N dots.

5. The electrostatic apparatus as recited in claim 4, wherein each aperture in one of said N rows is aligned to create one of a plurality of columns of toner dot locations on a media sheet.

6. The electrostatic apparatus as recited in claim 4, wherein each said first electrode comprises a conductive annulus which surrounds an associated aperture.

7. The electrostatic apparatus as recited in claim 6, wherein each said conductive annulus is positioned within and insulated by said insulator of determined thickness.

8. The electrostatic apparatus as recited in claim 1, wherein each said drive voltage drive level is adjusted so that when individually and capacitively coupled to a first electrode, said first electrode will exhibit a voltage level that is less than Vd, thereby enabling toner particles adherent to said address plate means near said first electrode to be attracted back to said developer surface.

* * * * *